United States Patent [19]

Harding

[11] Patent Number: 4,744,326

[45] Date of Patent: May 17, 1988

[54] SELF-BAILING INFLATABLE BOAT

[75] Inventor: Richard J. Harding, Trimsaran, Wales

[73] Assignee: Avon Inflatables Limited, Melksham, England

[21] Appl. No.: 839,568

[22] Filed: Mar. 14, 1986

[30] Foreign Application Priority Data

Oct. 11, 1985 [GB] United Kingdom ..... 8525103

[51] Int. Cl.[4] ..... B63B 7/00

[52] U.S. Cl. ..... 114/345; 114/197; 441/40

[58] Field of Search ..... 114/345, 346, 347, 348, 114/363, 174, 183 R, 183 A, 197, 198; 441/40, 67, 66, 130, 131

[56] References Cited

U.S. PATENT DOCUMENTS

| | | | |
|---|---|---|---|
| 529,786 | 11/1894 | Godfrey | 114/347 |
| 1,089,338 | 3/1914 | Greene | 114/197 |
| 1,456,168 | 5/1923 | Witmer et al. | 441/40 |
| 2,173,963 | 9/1939 | Eubank | 441/131 |
| 2,390,199 | 4/1945 | Walsh | 441/41 |
| 2,456,086 | 12/1948 | Schwall | 114/345 |
| 3,748,672 | 7/1973 | Patrick et al. | 441/131 |
| 4,084,530 | 4/1978 | Harris et al. | 114/345 |

*Primary Examiner*—Joseph F. Peters, Jr.
*Assistant Examiner*—Thomas J. Brahan
*Attorney, Agent, or Firm*—Cushman, Darby & Cushman

[57] ABSTRACT

Apertures in the floor of an inflatable boat are provided to render it self-bailing. They are formed by grommets penetrating the permanently-attached, continuous and integral floor which extends from one lateral buoyancy tube to the other, preferably in a thickened region thereof comprising a flange attachment to the tubes. They are overhung by the buoyancy tubes, when the floor is generally horizontal. An area in the central region of the floor is raised above the waterline of the boat.

9 Claims, 2 Drawing Sheets

SELF-BAILING INFLATABLE BOAT

This invention relates to inflatable boats and is concerned with giving such boats the capacity for "self-bailing" that is to say so that they will normally drain themselves of water which is taken inboard at a sufficient rate that they will not become waterlogged.

This capacity is particularly important when the boats are used in "white water" sports such as shooting river rapids or falls. If self-bailing is not provided the occupants of the boat have to work very fast to clear the boat of water shipped in the previous set of rapids before the next is reached.

BACKGROUND OF THE INVENTION

Inflatable boats are known which are self bailing. Most relevantly, self-bailing has been achieved by making the floor of the boat separate from a flange which projects inwardly from under the inflatable buoyancy tubes forming the margin of the boat, the flange and the floor both having registering eyelets in them, the flange and the floor being laced together by passing a rope or the like through the eyelets. The effect of this is to set up a floor where there is a gap formed around the edge by the vertical distancing effect of the two eyelets one upon the other so that there is a continuous series of slots, between the eyelets, the upper side of which is formed by the floor or the flange and the lower side by the flange or the floor, through which slots water can drain laterally. There is some drainage doubtless through the eyelets insofar as they are not occupied by the lacing. This arrangement has substantial disadvantages amongst which are: the separability of the floor and flange; a liability to catching or creasing of the spaced-apart overlapping flaps of the floor and flange; the liability of the lacing to wear stretch and catch; and above all a tendency for the inflatable tubes to stretch with time as a result of which the floor eyelets would no longer remain in register. It is also very expensive.

SUMMARY OF THE INVENTION

The present invention provides a self-bailing inflatable boat wherein drainage apertures are provided through a permanent floor which is permanently attached to the buoyancy tubes. The apertures are preferably grommeted so there is no weakening of the floor and no tendency for fissures to spread. Furthermore, the apertures may be provided in that part of the floor which is partly made up of a flange of the buoyancy tube, whereby they are in a part of the floor of greater thickness and therefore strength than the majority of the floor.

The attachment of the floor need not be at the bottom of the buoyancy tubes and, when it is not, the attachment and the undersurface of the apertures are protected from tearing or scraping on rocks or the like by being raised below the lowest level of the boat.

A central portion of the floor is arranged, preferably by being inflatable, so that an upper surface of this central portion of the floor is raised above the level of that portion of the floor having the apertures in it, so that when the inboard of the boat is not completely clear of water nevertheless that upper surface is above water level.

In this way we see that we have a floor which is non-removable and does not have any lacing or flaps which can catch or stretch. It is a simpler less costly and less weighty construction than that of the mentioned prior art.

Furthermore the rate of bailing can be easily regulated by the size and number of apertures provided which of course is independent of any need for using those apertures for securing of anything, as was the case in the prior art.

DESCRIPTION OF THE DRAWINGS

A particular embodiment of the invention will now be described by reference to the accompanying drawings wherein.

DESCRIPTION OF THE PREFERRED EMBODIMENT

Figure 1:
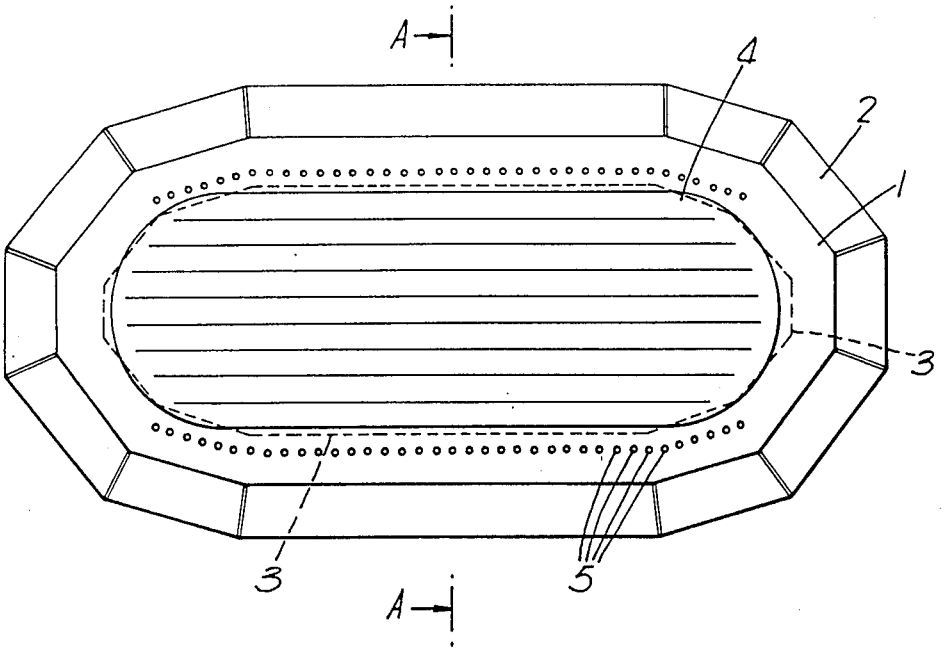
FIG. 1 is an underneath plan view of an embodiment of the invention.

In FIG. 1 which is an underplan view, the flexible sheet floor 1 of an inflatable boat is shown permanently secured to the buoyancy tubes 2 which completely surround it. The inner margin of the buoyancy tubes, above the floor, is shown by dotted line 3.

A central portion 4 of the floor is double skinned and inflatable.

Along each lateral side of the inflatable portion between it and the position of attachment of the floor to the respective lateral tubes 2 is a plurality of apertures 5 which are permanently open.

Figure 2:
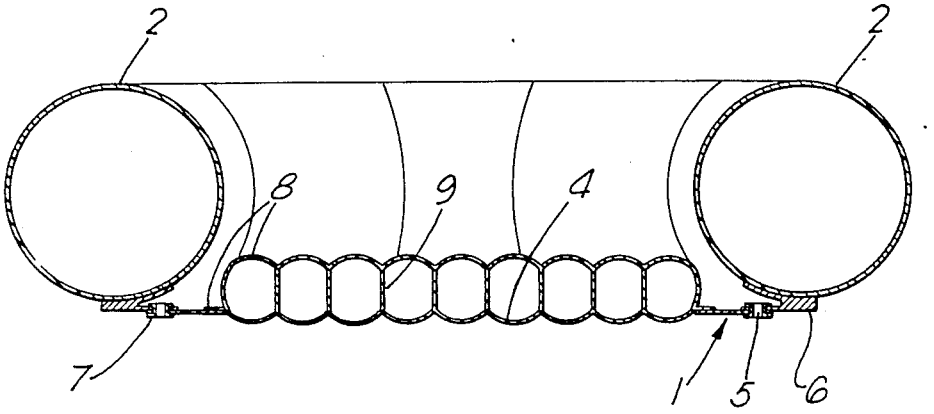
FIG. 2 is a section of the plane AA of FIG. 1.

As can best be seen from FIG. 2, the floor 1 is a skin of a conventional material for such boats such as a reinforced elastomer fabric. It is permanently bonded to the undersurface of a two-legged flange 6 running along all of the buoyancy tubes 2 and which is per se known for the attachment of a floor to an inflatable boat.

The apertures 5 have reinforcing grommets 7 defining their border, and are in the portion of the floor 1 at which the fabric is bonded to the underleg of the flange 6, so that the grommets are in a thickened part of that floor. The number, size and disposition of the apertures 5 is according to the size and expected rate of shipping of water of the boat. If they are placed comparatively close to the junction of the two legs of the flange 6 they are comparatively inaccessible from above, being vertically overhung by the buoyancy tubes when the floor is generally horizontal.

Figure 3:
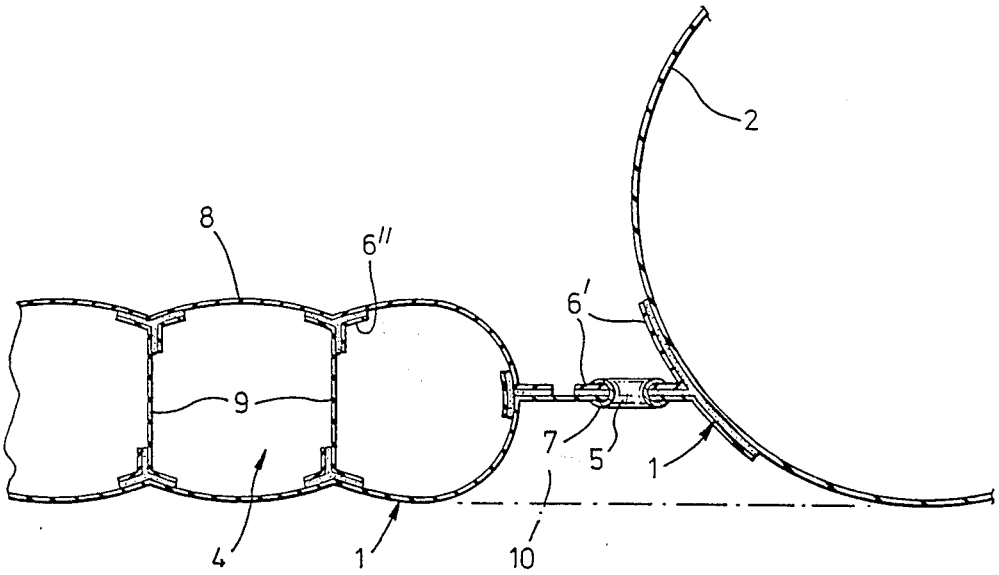
FIG. 3 is a section on a larger scale of a modification.

However, as shown in FIG. 3, which shows a presently preferred modification, if the floor is attached to the tube 2 at a level above the bottom of the tube, the effect is to form a channel 10 below the apertures and defined on one side by the bottom portion of the tube 2 and on the other by the edge of a central portion 4 of the floor. This recessing of the apertures protects them against tearing or chafing contact with rocks, etc. Here, the apertures are not overhung and are directly vertically accessible; but any of a range of positions of the attachment of floor to the tubes and of apertures in relation to the overhang of the tubes can be chosen.

In this aspect the modification of FIG. 3 is as described with reference to the main embodiment.

At the centre portion 4 of the floor, a raised region 8 is provided by a skin bonded to the sheet forming the floor and means are provided for inflation between them so as to raise the upper surface as can best be seen from FIGS. 2 and 3, above the level of the apertures 5 and above the normally expected waterline of the boat, so that the users of the boat may stay completely dry.

Conventional straps or dividers 9 may be provided to regulate the shape of the upper surface. There may also be provided on the raised region of the floor conventional fittings such as transverse seating, which may itself be an inflatable tube or tubes.

To attach the floor to the tube any suitable means may be used; as well as the two-legged flange of the first embodiment described or the direct attachment, reinforced by a flange 6', of the second embodiment, use for example of a three-legged flange is possible—two legs attached to the tube and one to the floor, analogously to flanges 6'' securing the dividers 9 in the second embodiment.

What is claimed is:

1. A self-bailing inflatable boat comprising:

a first buoyancy tube;

a second buoyancy tube;

a flexible floor extending continuously from said first buoyancy tube to said second buoyancy tube and lying below the normal waterline of the boat, and being permanently attached to said first and second buoyancy tubes;

seat means on said floor and raised above the normal waterline of the boat; and one or more permanently open apertures defined in said flexible floor below said waterline to act as drainholes, thereby rendering the boat self-bailing and normally maintaining a user of said boat on said seat means out of water taken into the boat.

2. A boat as claimed in claim 1 wherein said apertures are defined by grommets penetrating the floor in a region of the floor between said raised seat means on the floor and said tubes.

3. A boat as claimed in claim 2 wherein the floor comprises flange means permanently attached to the said tubes and a flexible sheet permanently attached to the flange means and thinner than said flange means, said grommets penetrating said flange means.

4. A boat as claimed in claim 3 wherein the raised seat means comprises an inflatable member on said flexible sheet forming said floor.

5. A boat as claimed in claim 1 wherein said flexible floor is directly permanently attached to said tubes.

6. A self-bailing inflatable boat comprising:

an inflatable buoyancy tube at each lateral side of the boat;

a flange attached permanently to each said inflatable buoyancy tube and having a leg extending generally inwardly of the boat;

a flexible floor of the boat extending integrally from one said inflatable tube to the other and permanently bonded to said legs whereby the whole of said floor is permanently attached to said inflatable tubes;

a plurality of apertures in said floor forming liquid-passing drainholes in said floor;

said apertures being defined by reinforcing grommets inserted in and penetrating through said floor; and a seat surface supported on a central portion of said floor to be raised thereabove so as normally to be above the waterline of the boat.

7. A boat as claimed in claim 6 wherein said grommets penetrate a portion of the floor comprising said legs.

8. A boat as claimed in claim 6, wherein said seat surface is supported by inflation of an inflatable member on said floor.

9. A self-bailing inflatable boat comprising:

a first buoyancy tube;

a second buoyancy tube;

flange means permanently attached to said tubes;

a flexible sheet thinner than said flange means and permanently attached to said flange means to form a flexible floor extending continuously from said first buoyancy tube to said second buoyancy tube;

a raised central area of the floor;

one or more apertures through the floor defined by grommets penetrating said flange means between said raised central area and said tubes.

* * * * *